US012729862B2

(12) United States Patent
Bianchi et al.

(10) Patent No.: US 12,729,862 B2
(45) Date of Patent: Sep. 8, 2026

(54) COOKING APPLIANCE HAVING A SUPPORT RACK

(71) Applicant: WHIRLPOOL CORPORATION, Benton Harbor, MI (US)

(72) Inventors: Fabio Bianchi, Ranco (IT); Massimiliano Frontini, Casciago (IT)

(73) Assignee: Whirlpool Corporation, Benton Harbor, MI (US)

( * ) Notice: Subject to any disclaimer, the term of this patent is extended or adjusted under 35 U.S.C. 154(b) by 358 days.

(21) Appl. No.: 18/613,651

(22) Filed: Mar. 22, 2024

(65) Prior Publication Data

US 2025/0297744 A1 Sep. 25, 2025

(51) Int. Cl.
*F24C 15/16* (2006.01)

(52) U.S. Cl.
CPC ..... *F24C 15/16* (2013.01)

(58) Field of Classification Search
CPC ..... F24C 15/16
See application file for complete search history.

(56) References Cited

U.S. PATENT DOCUMENTS 3,043,290 A * 7/1962 David ..... F24C 15/16 248/245
3,316,044 A * 4/1967 Carbary ..... A47L 15/504 108/106
5,429,043 A * 7/1995 Becker ..... F24C 15/16 99/450
2009/0095279 A1 4/2009 Ambrose et al.
2014/0238383 A1* 8/2014 Armstrong ..... F24C 15/16 126/337 A
2018/0288835 A1 10/2018 Celik et al.
2019/0271475 A1* 9/2019 Jung ..... F24C 15/16
2020/0116362 A1* 4/2020 Harward ..... F24C 15/16
2021/0212329 A1 7/2021 Garces et al.
2021/0388993 A1 12/2021 Ceron et al.

FOREIGN PATENT DOCUMENTS

EP 2757322 A1 7/2014
WO 2018024558 A1 2/2018

* cited by examiner

*Primary Examiner* — Alfred Basichas
(74) *Attorney, Agent, or Firm* — McGarry Bair PC

(57) ABSTRACT

A cooking appliance includes a cooking chamber defined by opposing side walls. A respective pair of mounting blocks are affixed to each of the side walls. The mounting blocks define respective first slots extending vertically, and second slots extending horizontally. A first support rack is coupled to the pair of mounting blocks on one side wall via insertion into the respective first and second slots, and a second support rack is coupled to the pair of mounting blocks on the other side wall via insertion into the respective first and second slots. A shelf can extend between, and be supported by, the first and second support racks.

20 Claims, 9 Drawing Sheets

COOKING APPLIANCE HAVING A SUPPORT RACK

TECHNICAL FIELD

The present disclosure generally relates to a rack assembly. More specifically, the present disclosure relates to a rack assembly for a cooking cavity of a household appliance such as an oven.

BACKGROUND

Cooking appliances such as ovens typically include a cooking chamber in which food is heated. Heat can be generated based on a flame, electric conduction, electric induction, microwaves, and the like. In some cases, a convection fan is used to provide a flow of heated air into the cooking chamber. A pair of wire racks is commonly attached onto opposing side walls of the cooking chamber using respective fasteners. The wire racks slidably support a shelf at one or more different selectable levels within the cooking chamber. A user places food to be cooked onto the shelf and places or inserts the shelf into the cooking chamber supported by the wire racks.

SUMMARY

According to one aspect of the present disclosure, a cooking appliance includes a cooking chamber defined in part by an opposingly spaced first side wall and second side wall, the cooking chamber defining a vertical direction, a first horizontal direction, and a second horizontal direction, the cooking chamber defining an access opening. A first mounting block and a second mounting block is affixed to the first side wall within the cooking chamber and spaced from each other in the first horizontal direction, the first and second mounting blocks each having a respective body portion defining a respective first slot, longitudinally extending in the vertical direction to define a first length and a respective second slot longitudinally extending in the first horizontal direction to define a second length. A first support rack is coupleable to the first and second mounting blocks, the first support rack including a first horizontal rail member longitudinally extending in the first horizontal direction from a first end to an opposing second end, a first vertical rail member coupled to the first horizontal rail member at the first end longitudinally extending in the vertical direction, and a second vertical rail member coupled to the first horizontal rail member at the second end, longitudinally extending in the vertical direction.

DETAILED DESCRIPTION

Figure 1:
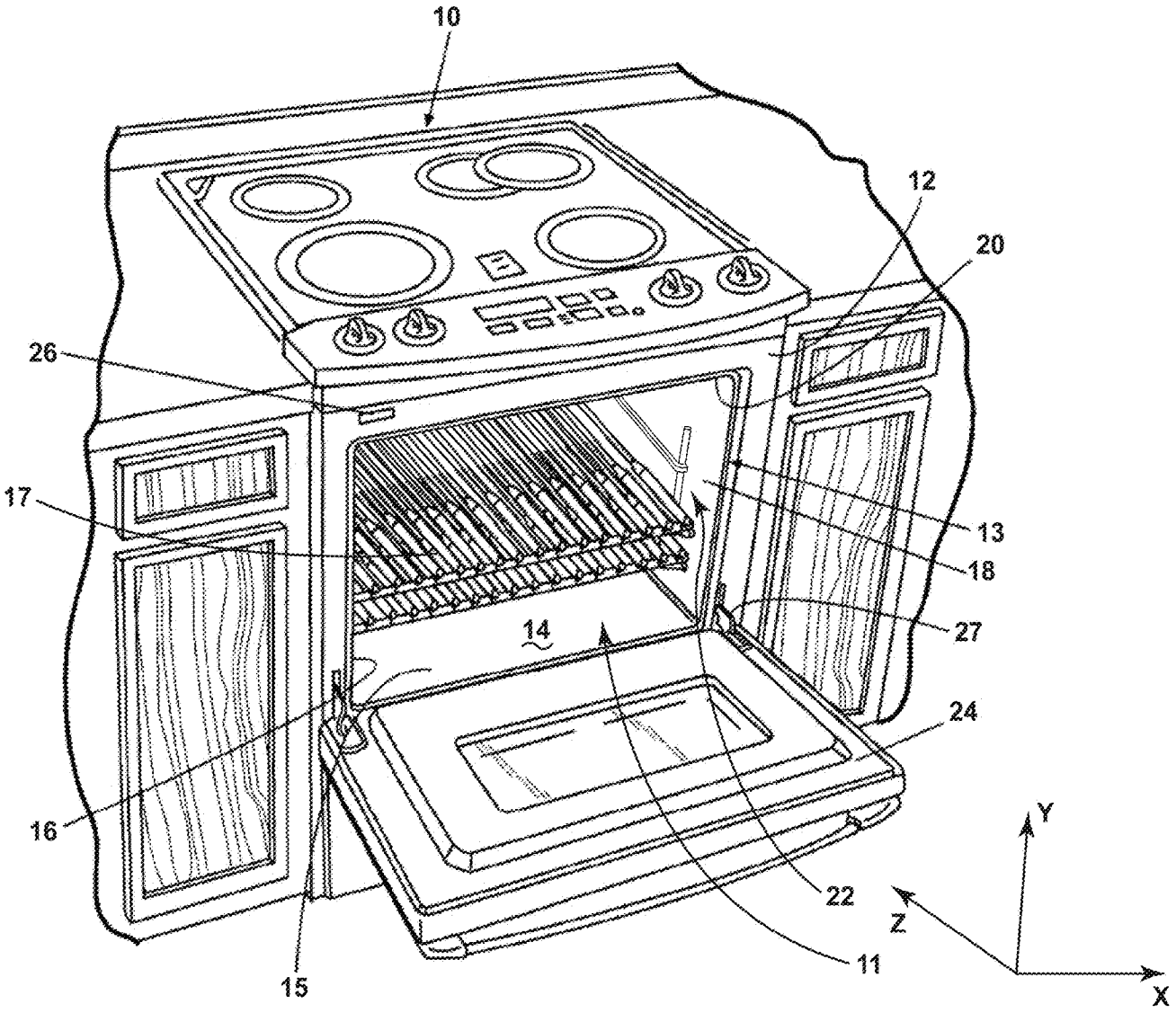
FIG. 1 is a perspective view of a cooking appliance, in accordance with aspects of the present disclosure.

In describing aspects illustrated in the drawings, specific terminology will be resorted to for the sake of clarity. However, it is not intended that the aspects be limited to the specific terms so selected and it is to be understood that each specific term includes all technical equivalents that operate in a similar manner to accomplish a similar purpose. For example, the words "connected," "attached," "coupled," and "supported" and variations thereof herein are used broadly and encompass direct and indirect connections, attachments, couplings, and supports. In addition, the terms "connected," "coupled," etc. and variations thereof are not restricted to physical or mechanical connections, couplings, etc. as all such types of connections should be recognized as being equivalent by those skilled in the art.

As used herein, the term "set" or "a set" of elements can be any non-zero number of elements, including only one. The exemplary drawings are for purposes of illustration only and the dimensions, positions, order and relative sizes reflected in the drawings attached hereto can vary.

The disclosure relates to household appliances having a support rack to support a shelf within a cooking chamber, and/or define a cooking level within the cooking chamber. While the disclosure is written in the context of an oven, the disclosure is applicable to any type of appliance having a shelf supportably arranged within a chamber, including without limitation, a refrigerator, microwave, toaster oven, dishwasher, and the like.

Referring to FIG. 1, a perspective view of an exemplary household cooking appliance is shown in the form of an oven 10 and can be used for cooking one or more food items. While the oven 10 is illustrated as a convection oven, however, in other aspects the oven can be a microwave oven, a standard oven, a compact oven, a pyrolytic (self-cleaning) oven, a pure steam oven, or other ovens as are well known, without departing from the disclosure herein. The oven 10 comprises a cabinet 12 with an open-face housing 13 having a pair of opposingly-spaced side walls, such as a first side wall 16, and a second side wall 18, the first and second side walls 16, 18 being joined by a top wall 20, a bottom wall 15, and a rear wall 19 (FIGS. 2A, 2B) to define a treating chamber or cooking chamber 14. The open-face housing 13 can define an access opening 11. The cooking chamber 14 can define a vertical direction "Y" (e.g., a height) direction, a first horizontal "Z" direction (e.g., a depth), and a second horizontal direction "X" (e.g., a width). A closure member or door 24 can be operably coupled to the cabinet 12 to selectively close the access opening 11. In the illustrated example, the door 24 is selectively pivotable at a hinge 27 between an open position as shown to allow user access to the cooking chamber 14, and a closed position (not shown) covering the access opening 11 and to prevent user access to the cooking chamber 14. A first sensor 26 can be provided to detect or otherwise provide an output signal indicative of a position of the door 24. It is contemplated that the first sensor 26 can provide a signal indicative of an opened position of the door 24, a closed position of the door 24, or both. When the door 24 is in the opened position, a user can access the cooking chamber 14. When the door 24 is in the closed position, the door 24 prevents access to the cooking chamber 14 and seals the cooking chamber 14 from the external environment. A set of removeable shelves 17 for supporting food items or cookware (e.g., a pot, not shown) can extend between the first and second side walls 16, 18. The shelves 17 can extend between, and be supported by, a first support rack 21 (FIG. 2B) and a second support rack 22.

Figure 2A:
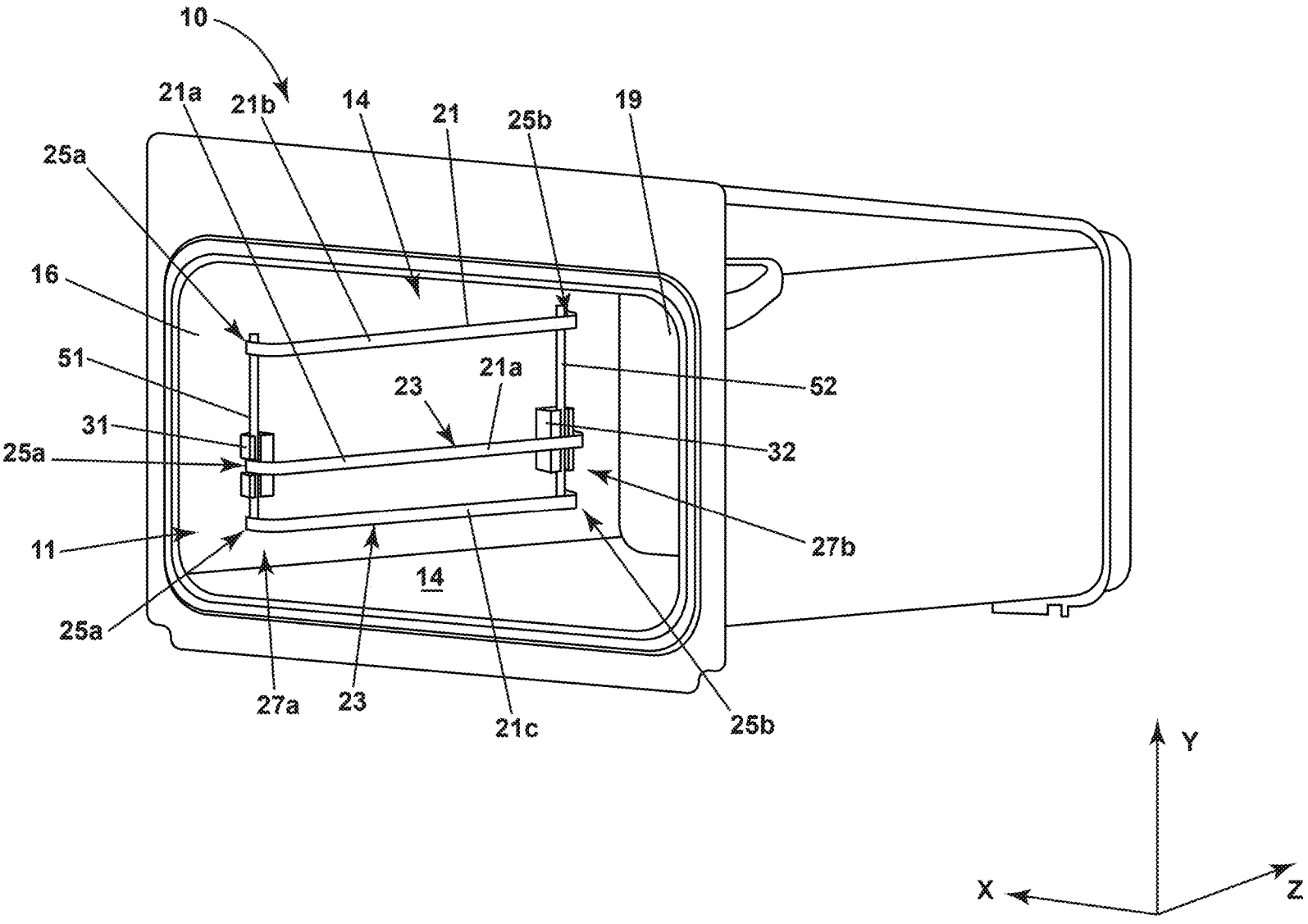
FIG. 2A is a side perspective view of a cooking cavity of the cooking appliance of FIG. 1, with some parts omitted for clarity, in accordance with aspects of the present disclosure.
Figure 2B:
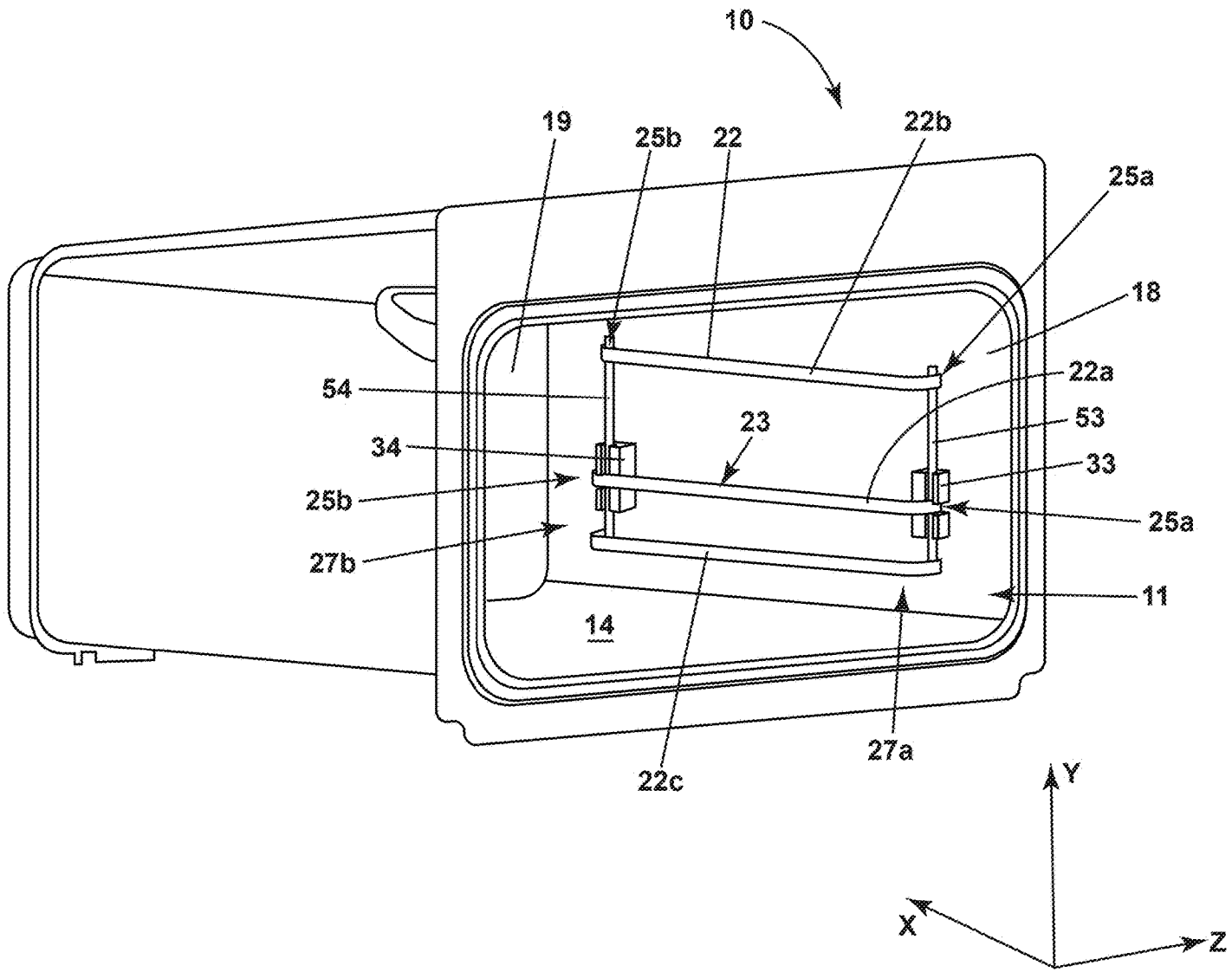
FIG. 2B is another side perspective view of the cooking cavity of the cooking appliance of FIG. 1, with some parts omitted for clarity, in accordance with aspects of the present disclosure.

FIGS. 2A and 2B are perspective views depicting an aspect of the cooking chamber 14 being viewed from opposing sides (e.g., right and left sides respectively), with various parts (e.g., the door 24, and shelves 17) omitted for clarity.

With simultaneous reference to FIGS. 2A and 2B, the first support rack 21 can be supportably coupled to the first side wall 16 via a first mounting block 31 and a second mounting block 32. The first and second mounting blocks 31, 32 are spaced apart from each other in the first horizontal direction Z within the cooking chamber 14 and affixed to the first side wall 16. The second support rack 22 can be supportably coupled to the second side wall 18 via a third mounting block 33 and a fourth mounting block 34. The third and fourth mounting blocks 33, 34 are spaced apart from each other in the first horizontal direction Z within the cooking chamber 14 and affixed to the second side wall 18.

The first support rack 21 can include a set of horizontal rail members 21*a*, 21*b*, 21*c*. While FIG. 2A depicts an aspect of the first support rack 21 having three first horizontal rail members 21*a*, 21*b*, 21*c*, other aspects can include any desired number of first horizontal support members, including only one first horizontal rail member 21*a*. The set of first horizontal rail members 21*a*, 21*b*, 21*c* can extend longitudinally in the first horizontal direction Z from a respective first end 27*a* to an opposing respective second end 27*b*. For example, the first end 27*a* can be proximal the access opening 11 while the second end 27*b* can be proximal the rear wall 19. The set of first horizontal rail members 21*a*, 21*b*, 21*c* can be substantially parallel to each other. In some aspects, a cross-section of the set of first horizontal rail members 21*a*, 21*b*, 21*c* can be substantially uniform along a length of the set of first horizontal rail members 21*a*, 21*b*, 21*c* In other aspects, the set of first horizontal rail members 21*a*, 21*b*, 21*c* may include a varied cross-section.

In the illustrated configuration, the set of first horizontal rail members 21*a*, 21*b*, 21*c* extend substantially parallel with the first side wall 16. However, it is contemplated that the set of first horizontal rail members 21*a*, 21*b*, 21*c* may be angled with respect to the first side wall 16. For example, the first support rack 21 may be angled toward the first side wall 16 and the access opening 11 to provide case in inserting/removing the shelf 17 (FIG. 1).

In non-limiting aspects the first horizontal rail members 21*a*, 21*b*, 21*c* can include a respective support portion 23, a respective first mounting portion 25*a*, and a respective second mounting portion 25*b*. The first mounting portion 25*a* can be arranged at the respective first end 27*a*, and the second mounting portion 25*b* can be arranged at the second end 27*b*. The support portion 23 can extend between the first and second mounting portions 25*a*, 25*b* and be coupled thereto. In some aspects, the support portion 23 can extend longitudinally transverse to the first and second mounting portions 25*a*, 25*b*. For example, in non-limiting aspects, the support portion 23 can extend in the first horizontal direction Z, and the first and second mounting portions 25*a*, 25*b* can extend therefrom in the second horizontal direction X. As illustrated in FIG. 2A, in some aspects, the support portion can be arranged parallel to the first side wall 16, while the first and second mounting portions 25*a*, 25*b* can be orthogonal to the side wall 16. In non-limiting aspects, the first horizontal rail members 21*a*, 21*b*, 21*c* can generally define a U-shape. In this way, respective support portion 23 of the first horizontal rail member 21*a*, 21*b*, 21*c* are offset from the first side wall 16.

The first horizontal rail members 21*a*, 21*b*, 21*c* are spaced from each other in the vertical direction Y and can be arranged generally parallel to one another. The first support rack 21 can further include a first vertical rail member 51 and a second vertical rail member 52. The first and second vertical rail members 51, 52 can extend longitudinally in the vertical direction Y, and are spaced from each other in the first horizontal direction Z. The first and second vertical rail members 51, 52 can be substantially parallel to each other. In some aspects, a cross-section of the first and second vertical rail members 51, 52 may be substantially uniform along a length of the first and second vertical rail members 51, 52. In other aspects, the first and second vertical rail members 51, 52 may include a varied cross-section.

In the illustrated configuration, the set of second horizontal rail members 22*a*, 22*b*, 22*c* extend substantially parallel with the second side wall 18. However, it is contemplated that the second horizontal rail members 22*a*, 22*b*, 22*c* may be angled with respect to the second side wall 18. For example, the second support rack 22 can be angled toward the second side wall 18 and the access opening 11 to provide case in inserting/removing the shelf 17 (FIG. 1).

The first vertical rail member 51 can be coupled to the first horizontal rail members 21*a*, 21*b*, 21*c* at the respective first end 27*a*. For example, the first vertical rail member 51 can be coupled to the first horizontal rail members 21*a*, 21*b*, 21*c* by welding, adhesive, mechanical fasteners, etc. Alternatively, the first vertical rail member 51 and the first horizontal rail members 21*a*, 21*b*, 21*c*, may be integrally formed as a single unitary piece. In some aspects, as illustrated, first vertical rail member 51 can be coupled to the first horizontal rail members 21*a*, 21*b*, 21*c* at the respective first mounting portion 25*a*.

In various aspects, the first horizontal rail members 21*a*, 21*b*, 21*c* and the second horizontal rail members 22*a*, 22*b*, 22*c* can each have a substantially rectangular or square cross-sectional shape with radii at the edges that may vary depending on aesthetic proportions. The rectangular cross-section of the first horizontal rail members 21*a*, 21*b*, 21*c* and the second horizontal rail members 22*a*, 22*b*, 22*c* allow the first horizontal rail members 21*a*, 21*b*, 21*c* and the second horizontal rail members 22*a*, 22*b*, 22*c* to have a flat appearance and be generally coplanar with each other. The rectangular cross-section of the first horizontal rail members 21*a*, 21*b*, 21*c* and the second horizontal rail members 22*a*, 22*b*, 22*c* provides a more flush and integrated aesthetic for the first and second support racks 21, 22. In other non-limiting aspects the first horizontal rail members 21*a*, 21*b*, 21*c* and the second horizontal rail members 22*a*, 22*b*, 22*c* can include a substantially oblong, oval, or circular cross-section. It is further contemplated that each of the first horizontal rail members 21*a*, 21*b*, 21*c* and the second horizontal rail members 22*a*, 22*b*, 22*c* may differ from each other to include any variety of features or appearances without departing from the disclosure herein.

The second vertical rail member 52 can be coupled to the first horizontal rail members 21*a*, 21*b*, 21*c* at the respective second end 27*b*. For example, the second vertical rail member 52 can be coupled to the first horizontal rail members 21*a*, 21*b*, 21*c* by welding, adhesive, mechanical fasteners, etc. Alternatively, the second vertical rail member 52 and the second horizontal rail members 22*a*, 22*b*, 22*c*, may be integrally formed as a single unitary piece. In some aspects, as illustrated, second vertical rail member 52 can be coupled to the first horizontal rail members 21*a*, 21*b*, 21*c* at the respective second mounting portion 25*b*.

In some aspects, the first vertical rail member 51 can be proximal the access opening while the second vertical rail member 52 can be proximal the rear wall 19.

It is contemplated that in some aspects, the second support rack 22 can be essentially identical to the first support rack 21. In other non-limiting aspects, the second support rack 22 can be a mirror image of the first support rack 21. Accordingly, details discussed herein with respect to the first support rack 21 can also be applied to the second support rack 22.

In non-limiting aspects, the second support rack 22 can include a set of second horizontal rail member 22*a*, 22*b*, 22*c*. While FIG. 2B depicts an aspect of the second support rack 22 having three second horizontal rail members 22*a*, 22*b*, 22*c*, other aspects can include any desired number of second horizontal support members, including only one second horizontal rail member 22*a*. The set of second horizontal rail members 22*a*, 22*b*, 22*c* can extend longitudinally in the first horizontal direction Z from a respective first end 27*a* to an opposing respective second end 27*b*. For example, the first end 27*a* can be proximal the access opening 11 while the second end 27*b* can be proximal the rear wall 19. The second horizontal rail members 22*a*, 22*b*, 22*c* are spaced from each other in the vertical direction Y and can be arranged generally parallel to one another. In some aspects, a cross-section of the set of second horizontal rail members 22*a*, 22*b*, 22*c* can be substantially uniform along a length of the set of second horizontal rail members 22*a*, 22*b*, 22*c* In other aspects, the set of second horizontal rail members 22*a*, 22*b*, 22*c* may include a varied cross-section.

The second support rack 22 can include a third vertical rail member 53 and a fourth vertical rail member 54. The third and fourth vertical rail members 53, 54 can extend longitudinally in the vertical direction Y, and are spaced from each other in the first horizontal direction Z. The third and fourth vertical rail members 53, 54 can be substantially parallel to each other. The second and third vertical rail members 52, 53 can be substantially parallel to each other. In some aspects, a cross-section of the second and third vertical rail members 52, 53 can be substantially uniform along a length of the second and third vertical rail members 52, 53. In other aspects, the second and third vertical rail members 52, 53 may include a varied cross-section.

The third vertical rail member 53 can be coupled to the second horizontal rail members 22*a*, 22*b*, 22*c* at the respective first end 27*a*. For example, the third vertical rail member 53 can be coupled to the second horizontal rail members 22*a*, 22*b*, 22*c* by welding, adhesive, mechanical fasteners, etc. Alternatively, the third vertical rail member 53 and the second horizontal rail members 22*a*, 22*b*, 22*c*, may be integrally formed as a single unitary piece.

The fourth vertical rail member 54 can be coupled to the second horizontal rail members 22*a*, 22*b*, 22*c* at the respective second end 27*b*. For example, the fourth vertical rail member 54 can be coupled to the second horizontal rail members 22*a*, 22*b*, 22*c* by welding, adhesive, mechanical fasteners, etc. Alternatively, the fourth vertical rail member 54 and the second horizontal rail members 22*a*, 22*b*, 22*c*, may be integrally formed as a single unitary piece.

In some aspects, the third vertical rail member 53 can be proximal the access opening 11, while the fourth vertical rail member 54 can be proximal the rear wall 19.

In non-limiting aspects the second horizontal rail members 22*a*, 22*b*, 22*c* can include a respective support portion 23, a respective first mounting portion 25*a*, and a respective second mounting portion 25*b*. The first mounting portion 25*a* can be arranged at the respective first end 27*a*. The second mounting portion 25*b* can be arranged at the respective second end 27*b*. The support portion 23 can extend between the first and second mounting portions 25*a*, 25*b* and be coupled thereto. In some aspects, the support portion 23 can extend longitudinally transverse to the first and second mounting portions 25*a*, 25*b*. For example, in non-limiting aspects, the support portion 23 can extend in the first horizontal direction Z, and the first and second mounting portions 25*a*, 25*b* can extend therefrom in the second horizontal direction X. As illustrated in FIG. 2B, in some aspects, the support portion can be arranged parallel to the second side wall 18, while the first and second mounting portions 25*a*, 25*b* can be orthogonal to the second side wall 16. In non-limiting aspects, the second horizontal rail members 22*a*, 22*b*, 22*c* can generally define a U-shape. In this way, respective support portions 23 of the second horizontal rail members 22*a*, 22*b*, 22*c* are offset from the second side wall 18.

Each first horizontal rail member 21*a*, 21*b*, 21*c* can be spaced from a corresponding second horizontal rail member 22*a*, 22*b*, 22*c* to generally define a separate cooking level therebetween. Non-limiting aspects can include the first support rack 21 and the second support rack 22 arranged within the cooking chamber 14 to cooperatively support the shelf 17 (FIG. 1) on opposing sides of the cooking chamber 14 at a respective cooking level. The shelf 17 can extend from a respective first horizontal rail member 21*a*, 21*b*, 21*c* to a corresponding second horizontal rail member 22*a*, 22*b*, 22*c*. Further, more than one cooking shelf 17 may be supported by the first and second support racks 21, 22 at any given time. The first and second support racks 21, 22 can individually or cooperatively define multiple cooking levels at different heights within the cooking chamber 14. Different cooking levels may be advantageous for different types of food or for supporting multiple cooking shelves 17 simultaneously.

Figure 3:
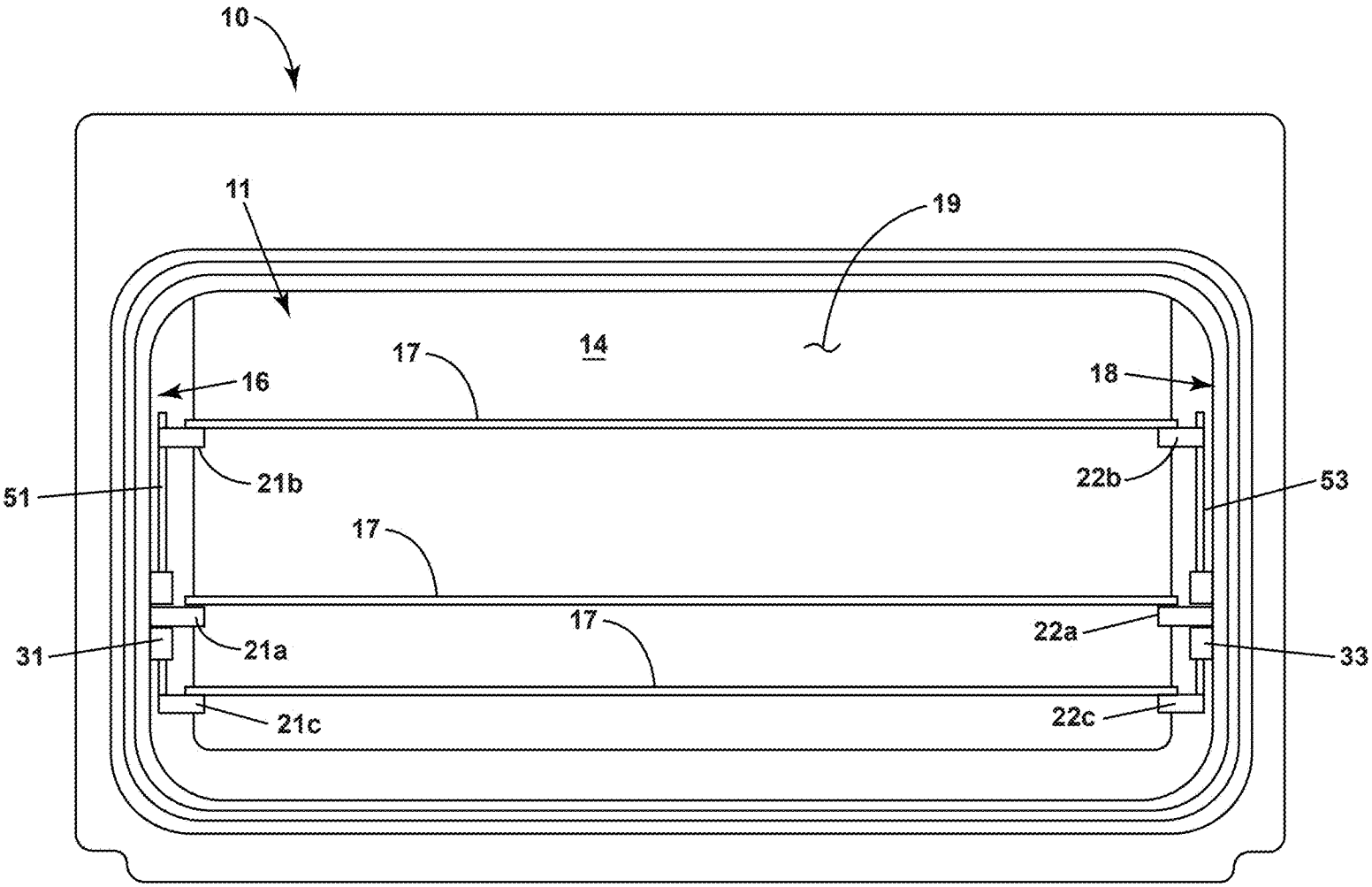
FIG. 3 is an isometric front view of the cooking cavity of FIGS. 2A and 2B, with some parts omitted for clarity, in accordance with aspects of the present disclosure.

FIG. 3 depicts an isometric front view of the cooking cavity of FIGS. 2A and 2B, (e.g., when viewing through the access opening 11 toward the rear wall 19). The first mounting block 31 and second mounting block 32 can be coupled to the first side wall 16 and second side wall 18, respectively, within the cooking chamber 14. The first vertical rail member 51 can be removeably coupled to the first mounting block 31, and the third vertical rail member 53 can be removeably coupled to the third mounting block 33.

The first horizontal rail members 21*a*, 21*b*, 21*c*, can be coupled to the first vertical rail member 51 at their respective first mounting portions 25*a*. The first horizontal rail members 21*a*, 21*b*, 21*c* can be arranged substantially parallel to each other and/or parallel to the first side wall 16. The second horizontal rail members 22*a*, 22*b*, 22*c*, can be coupled to the third vertical rail member 53 at their respective first mounting portions 25*a*. The set of second horizontal rail members 22*a*, 22*b*, 22*c* can be substantially parallel to each other and/or parallel to the second side wall 18. The set of second horizontal rail members 22*a*, 22*b*, 22*c* can further be arranged substantially parallel to the set of first horizontal rail members 21*a*, 21*b*, 21*c*.

At least one of the first horizontal rail members 21*a*, 21*b*, 21*c* can be aligned in registry with a corresponding at least one of the second horizontal rail members 22*a*, 22*b*, 22*c*. A respective shelf 17 can extend between and be supported by the corresponding horizontal rail members 21*a*, 21*b*, 21*c* and second horizontal rail members 22*a*, 22*b*, 22*c* to cooperatively define a cooking level within the cooking chamber 14.

Figure 4B:
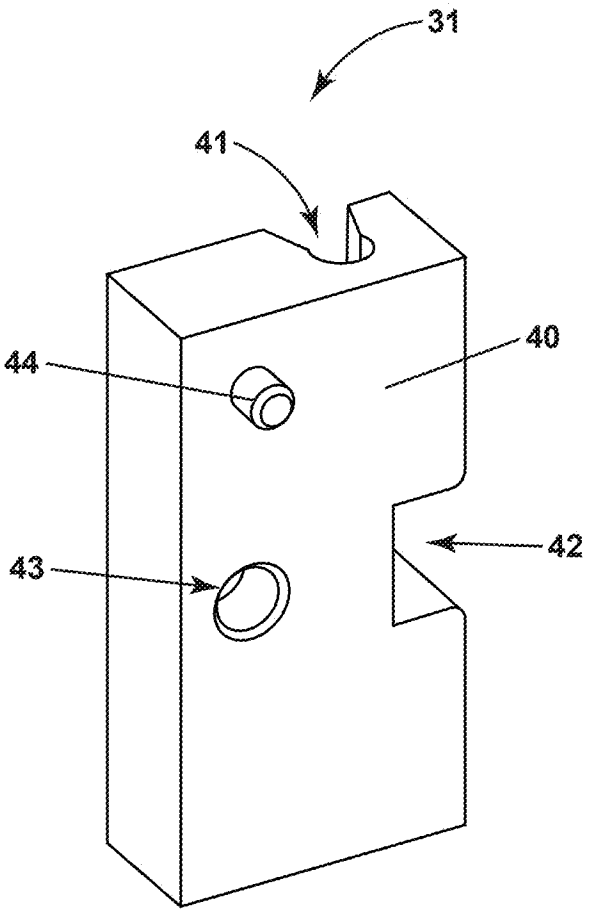
FIG. 4B is an isometric rear view of the mounting block of FIG. 3A, in accordance with aspects of the present disclosure.
Figure 4A:
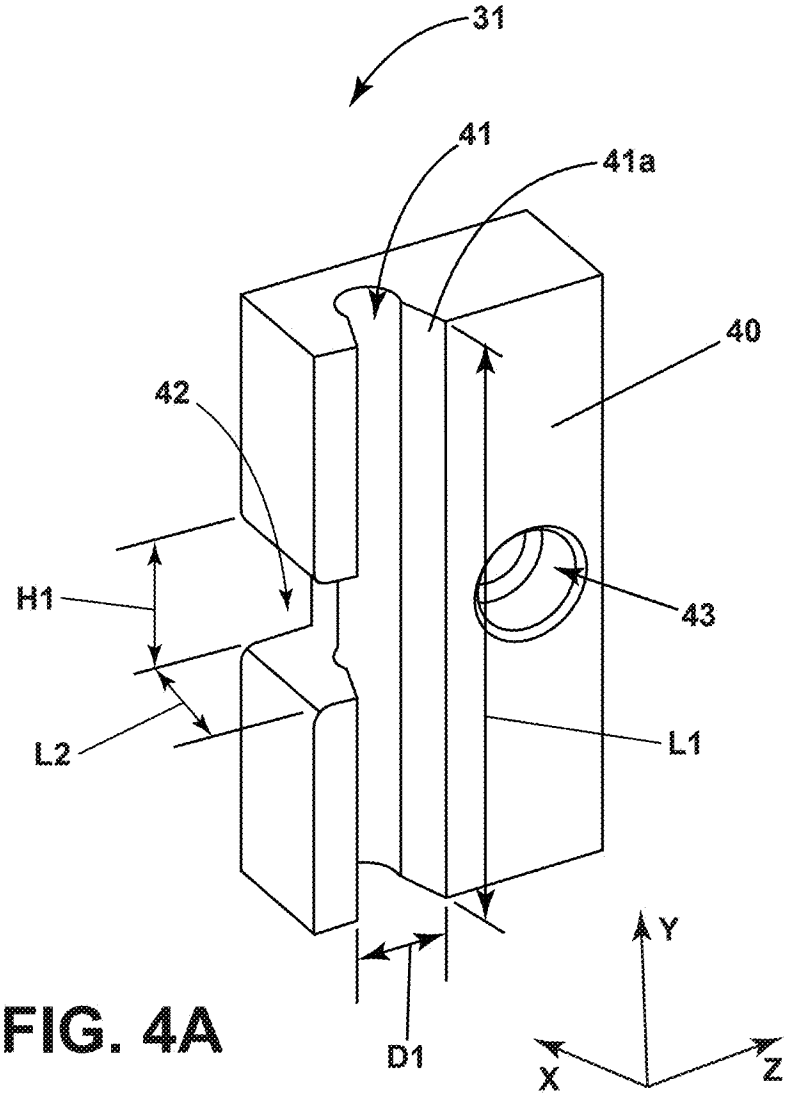
FIG. 4A is an isometric front view of a mounting block, in accordance with aspects of the present disclosure.
Figure 5B:
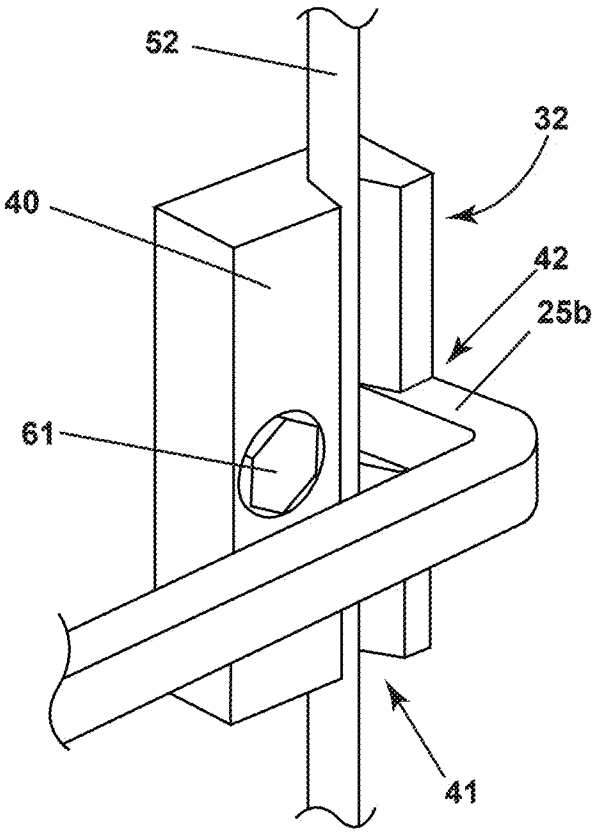
FIG. 5B depicts an isometric front view of another mounting block, having a respective support rack coupled thereto, in accordance with aspects of the present disclosure.
Figure 5A:
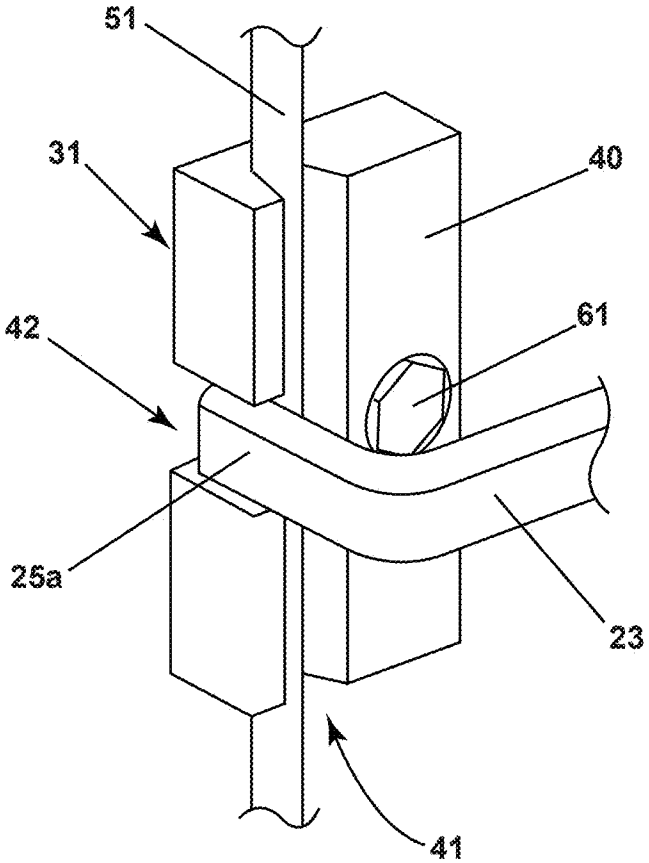
FIG. 5A depicts an isometric front view of the mounting block of FIG. 3A, having a respective support rack coupled thereto, in accordance with aspects of the present disclosure.

FIG. 4A depicts a front view of a non-limiting aspect of an exemplary first mounting block 31. FIG. 4B depicts a rear view of a non-limiting aspect off the mounting of FIG. 4A. FIG. 5A depicts a front view of the first mounting block 31 of FIG. 4A, having a respective first support rack 21 operatively coupled thereto. FIG. 5B depicts an isometric front view of the second mounting block 32 having the first support rack 21 operatively coupled thereto.

In non-limiting aspects the first, second, third, or fourth mounting blocks 31, 32, 33, 34 can be identical to each other. Accordingly, while FIGS. 4A-4B, and -5A-5B are discussed herein with respect to the first mounting block 31 and second mounting block 32, for brevity of description and ease of understanding, details discussed herein with respect to the first mounting block 31 and second mounting block 32 may also be applied, mutatis mutandis, to any of the first, second, third, or fourth mounting blocks 31, 32, 33, 34.

With simultaneous reference to FIGS. 4A-4B and 5A-5B, in non-limiting aspects, the first, second, third, or fourth mounting blocks 31, 32, 33, 34 can include a respective body portion 40. Each respective body portion 40 can define a first retaining feature such as a first slot 41, a second retaining feature such as a second slot 42, and a first aperture 43.

In non-limiting aspects, the first slot 41 can extend longitudinally in the vertical direction Y to define a first length L1. In some aspects, the first slot 41 can be elongate and extend an entire length of the body portion 40. The first slot 41 can further define a first width D1, extending orthogonal to the first length L1, and sized to receive a respective vertical rail member 51, 52, 53, 54 therein. In non-limiting aspects, the respective first slot can be substantially straight along the first length L1. For example, in non-limiting aspects, the first mounting block 31 can include a respective first slot 41, sized to receive the first vertical rail member 51 therein, while the second mounting block 32 can include a respective first slot 41 sized to receive the second vertical rail member 52 therein. Similarly, for example, in non-limiting aspects, the third mounting block 33 can include a respective first slot 41, sized to receive the third vertical rail member 53 therein, while the fourth mounting block 34 can include a respective first slot 41 sized to receive the fourth vertical rail member 54 therein. In non-limiting aspects, the first vertical rail member 51 and the second vertical rail member 52 received in the respective first slots 41 of the first and second mounting blocks 31, 32 can be substantially straight along their respective first length L1.

In non-limiting aspects, the first slot 41 can be sized to arrange a snap-fit engagement with the respective vertical rail portion 51-54. For example, first slot 41 can be sized such that the respective vertical rail portions 51-54 are received within the first slot 41 by press-fitting the respective vertical rail portions 51-54 into the corresponding first slot 41. It is also contemplated that each vertical rail portion 51-54 may be mechanically coupled to the respective mounting blocks 31-34 with fasteners or adhesives.

In non-limiting aspects, the second slot 42 can extend longitudinally in the vertical second horizontal direction X to define a second length L2. The second slot 42 can define a first height H1, extending orthogonal to the second length L2, sized to receive a respective first horizontal rail member 21*a*, 21*b*, 21*c* or second horizontal rail member 22*a*, 22*b*, 22*c*, therein. In some aspects, the second slot 42 can be elongate and extend an entire width (e.g., in the second horizontal direction X) of the body portion 40. In non-limiting aspects, the second slot 42 can be substantially straight along the second length L2.

For example, in some aspects, the first mounting block 31 can include a respective second slot 42, sized to receive the first mounting portion 25*a* of the first horizontal rail member 21*a*, 21*b*, 21*c* therein, while the second mounting block 32 (FIG. 2A) can include a respective second slot 42 sized to receive the second mounting portion 25*b* (FIG. 2A) of the respective first horizontal rail member 21*a*, 21*b*, 21*c* therein. Similarly, for example, in non-limiting aspects the third mounting block 33 (FIG. 2B) can include a respective second slot 42, sized to receive the first mounting portion 25*a* of a respective second horizontal rail member 22*a*, 22*b*, 22*c* therein, while the fourth mounting block 34 (FIG. 2B) can include a respective second slot 42 sized to receive the second mounting portion 25*b* (FIG. 2B) of a respective second horizontal rail member 22*a*, 22*b*, 22*c* therein. In non-limiting aspects, the second slot 42 can be sized to arrange a snap-fit engagement with the respective first horizontal rail member 21*a*, 21*b*, 21*c* or second horizontal rail member 21*a*, 22*a*, 22*b*, 22*c*. In non-limiting aspects, the first mounting portion 25*a* and the second mounting portion 25*b* received in the respective second slots 42 of the first and second mounting blocks 31, 32 are substantially straight within the second slot 42.

The first aperture 43 of each respective body portion 40 of the first, second, third, or fourth mounting blocks 31, 32, 33, 34 can be sized to receive a respective mechanical fastener (e.g., a screw or a bolt) therethrough. The body portion 40 can be formed using any desired material. For example, in non-limiting aspects, the first, second, third, or fourth mounting blocks 31, 32, 33, 34 can be formed of steel or aluminum. In other non-limiting aspects, the first, second, third, or fourth mounting blocks 31, 32, 33, 34 can be formed of Teflon.

Figure 6:
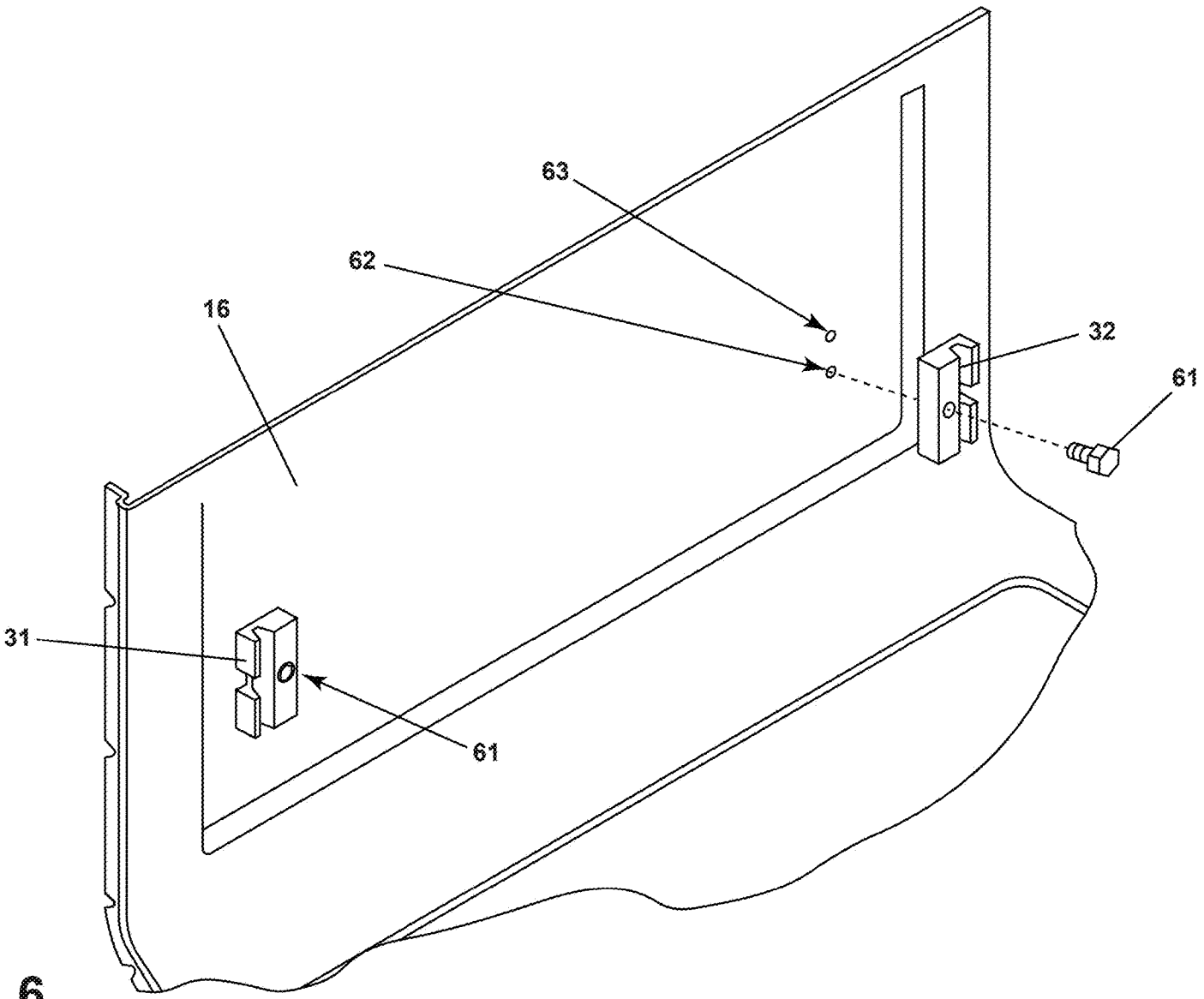
FIG. 6 is a partially exploded view of cooking cavity of the cooking appliance, with some parts omitted for clarity, in accordance with aspects of the present disclosure.

As depicted in FIG. 4B, the first, second, third, or fourth mounting blocks 31, 32, 33, 34 can include an anti-rotation feature 44, such as a pin, boss, hook, or other protrusion extending from the body portion 40, sized and disposed to engage with a complementary feature such as a second aperture 63 defined on the first or second side walls 16, 18 (FIG. 6). In non-limiting aspects, the anti-rotation feature 44 can be a slot, groove, aperture, or other recess (not shown) defined in the body portion 40, and sized and disposed to engage with a complementary feature such as pin, boss, hook, or other protrusion extending from the first side wall 16. In still other non-limiting aspects, the anti-rotation feature 44 can be an aperture (not shown) sized to receive a mechanical fastener (e.g., a screw, not shown) therethrough.

With simultaneous reference to FIG. 5A-5B, the first mounting block 31 and second mounting block 32 can be respectively coupled to the first side wall 16 via the first fastener 61 disposed in the first aperture 43. The first vertical rail member 51 can be disposed in the first slot 41 of the first mounting block. The second vertical rail member 52 can be disposed in the first slot 41 of the second mounting block 32. When the first vertical rail member 51 is disposed in the first slot 41, the body portion 40 defining the first slot 41 prevents, obstructs, or otherwise reduces a movement of the first vertical rail member 5*a* in the first horizontal direction Z. Likewise, when the second vertical rail member 52 is disposed in the first slot 41 of the second mounting block 32, the body portion 40 defining the first slot 41 prevents, obstructs, or otherwise reduces a movement of the second vertical rail member 52 in the first horizontal direction Z. A respective first horizontal rail member 21*a* can be disposed in the second slot 42 of the first mounting block 31 at the first mounting portion 25*a* and can be further disposed in the second slot 42 of the second mounting block 32 at the second mounting portion 25*b*. When the first horizontal rail member 21*a* is disposed in the second slot 42 of the first mounting block 31, the body portion 40 defining the second slot 42 of the first mounting block prevents or obstructs a movement of the first vertical rail member 51 in the vertical direction Y. Likewise, when the first horizontal rail member 21*a* is disposed in the second slot 42 of the second mounting block 32, the body portion 40 defining the second slot 42 if the second mounting block prevents or obstructs a movement of the second vertical rail member 52 in the vertical direction Y.

FIG. 6 is a partially exploded perspective view of the first side wall 16, and the first and second mounting blocks 31, 32. The first mounting block 31 is shown as coupled to the first side wall 16, via a respective first fastener 61. The first side wall 16 can define a set of fastener-receiving second apertures 62, sized and disposed to receive a respective first fastener 61 therethrough. In non-limiting aspects, the first side wall 16 can define a set of third apertures 63 sized and disposed to receive a respective anti-rotation feature 44 (FIG. 4B) extending from the body portion 40 of the respective first and second mounting blocks 31, 32.

In non-limiting aspects, at least one of the anti-rotation feature 44 (FIG. 4B) extending from the body portion 40 of the respective first and second mounting blocks 31, 32 and the first side wall 16 defining the third apertures 63 may be configured to elastically deform as the anti-rotation feature 44 is pushed through the third aperture 63. Accordingly, the anti-rotation feature 44 may function as an integral attachment feature (e.g., a snap-fit feature). The anti-rotation feature 44 may include external threads (not shown) configured to receive a nut, which may be rotatably fastened thereon and which may engage the exterior surface of the first side wall 16 to secure the first support rack 21 to the first side wall 16.

The first fastener 61 and/or anti-rotation feature 44 can extend through the second and third apertures 62, 63 respectively, and engage the exterior surface of the first side wall 16. The first support rack 21 can then be retained to the first side wall 16 through the engagement between the first side wall 16 and the first fastener 61 and/or anti-rotation feature 44. This engagement can reduce movement of the first support rack 21 relative to the first side wall 16 and can provide convenient engagement and disengagement between first support rack 21 and the first side wall 16.

Aspects as described herein enable easy installation and/or removal of the first and second support racks 21, 22 into the coking chamber 14.

Figure 7A:
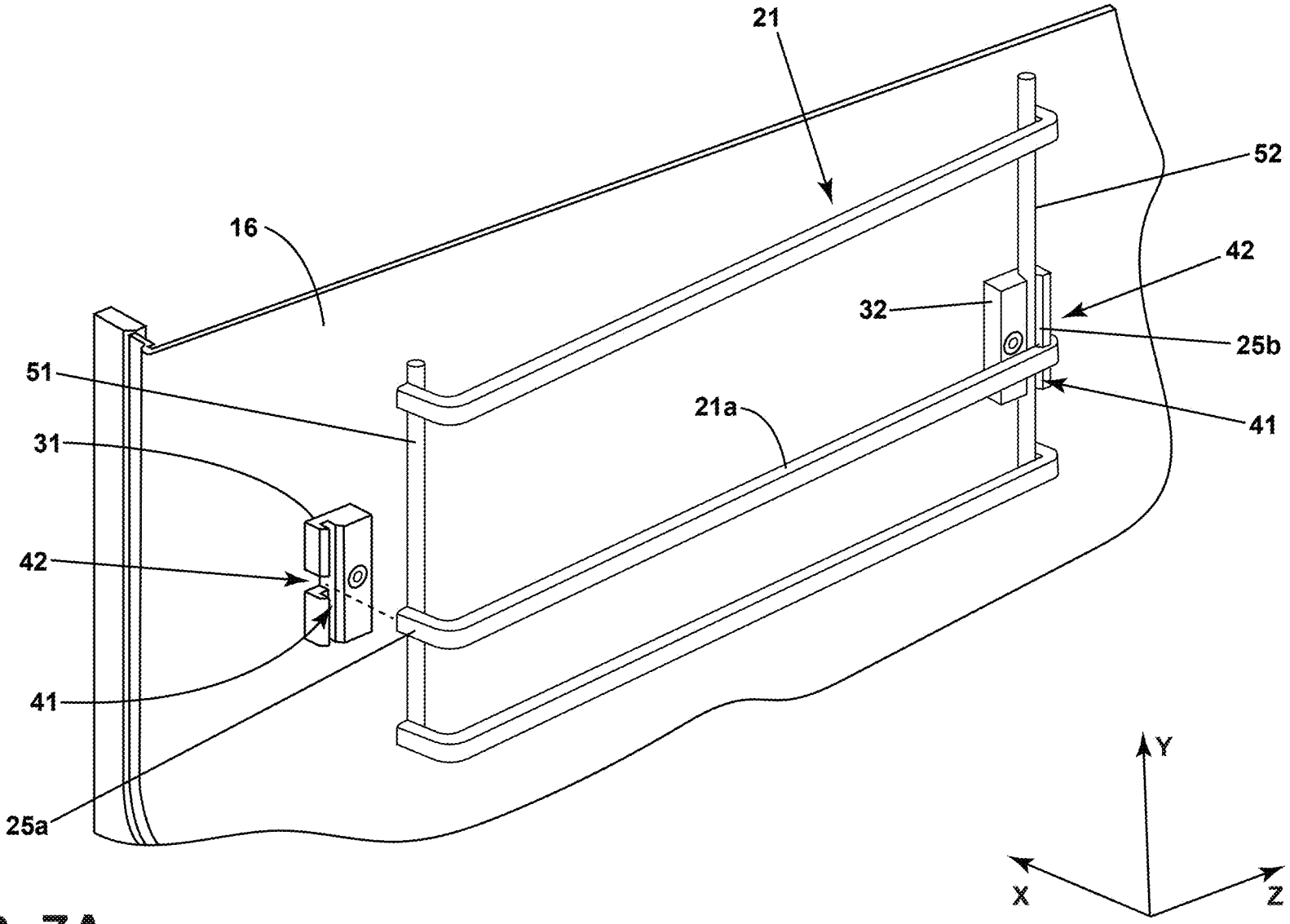
FIG. 7A is a side perspective view of a first support rack partially separated from a side wall, with some parts omitted for clarity, in accordance with aspects of the present disclosure.
Figure 7B:
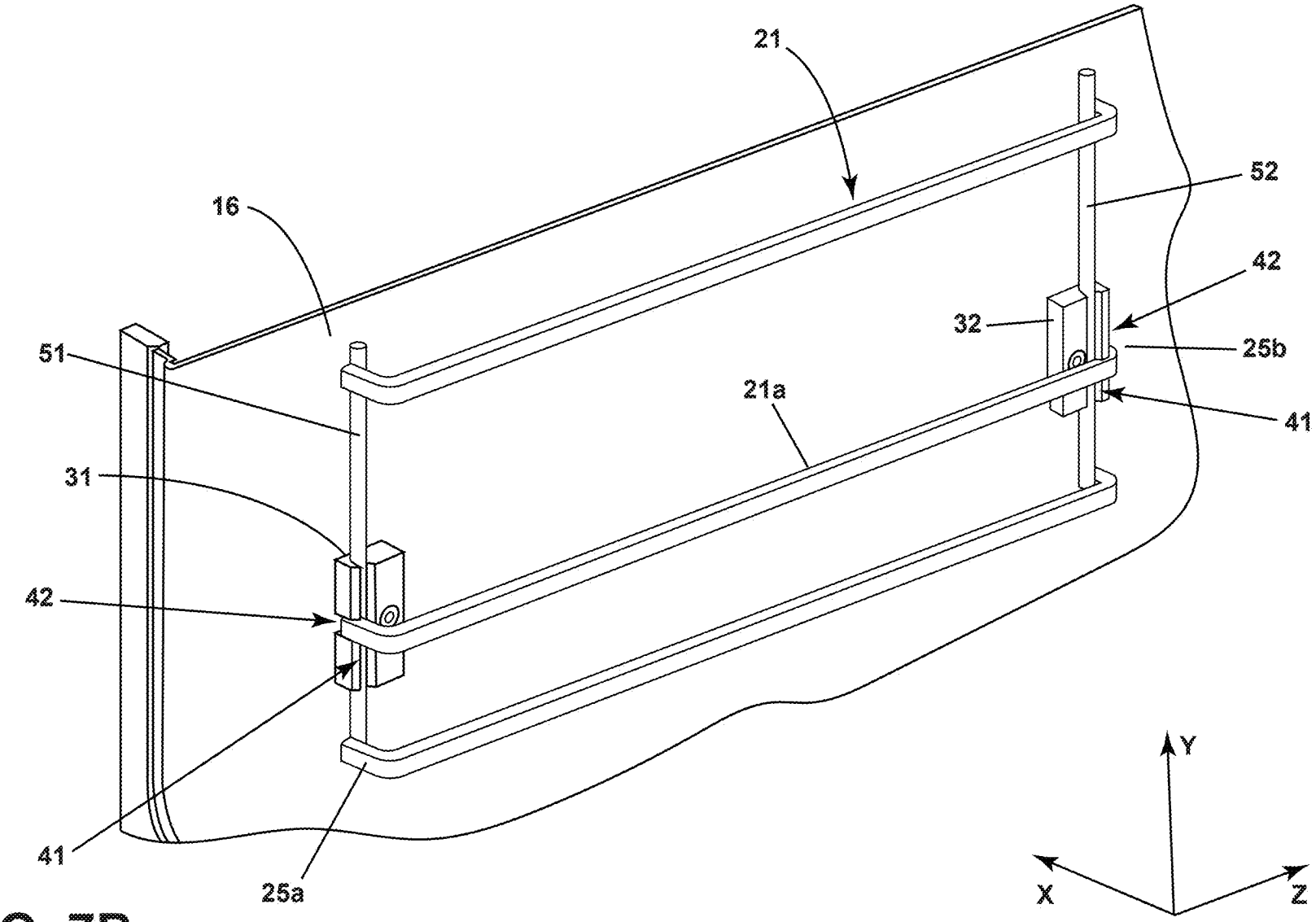
FIG. 7B is a side perspective view of the first support rack of FIG. 5A installed within the cooking chamber, with some parts omitted for clarity, in accordance with aspects of the present disclosure.

FIG. 7A is a perspective view of the first support rack 21 only partially installed or coupled to the first side wall 16, and FIG. 7B is a perspective view of the first support rack 21 of FIG. 7A fully installed into or coupled to the first side wall 16. It will be understood that while FIGS. 7A-7B are discussed herein with respect to the first support rack 21 and first and second mounting blocks 31, 32, for brevity of description and ease of understanding, the details discussed herein may also be applied, mutatis mutandis, to the second support rack 22 and the third and fourth mounting blocks 33, 34.

As depicted in FIG. 7A, in non-limiting aspects, the first support rack 21 can be coupled to the first side wall 16 by inserting, or "pushing" the first support rack 21 into engagement with the second mounting block 32. For example, the second vertical rail member 52 can be inserted or snap-fittingly engaged into the first slot 41 of the second mounting block 32, and the second mounting portion 25*b* of the first horizontal rail member 21*a* can be received into the second slot 42 of the second mounting block. In this way, the first support rack 21 can be partially locked, clamped or otherwise retained at a selected cooking height within the cooking chamber 14.

As depicted in FIG. 7B, the first support rack 21 can be further coupled to the first side wall 16 by inserting, or "pushing" the first support rack 21 into engagement with the first mounting block 31. For example, the first vertical rail member 51 can be inserted or snap-fittingly engaged into the first slot 41 of the first mounting block 31, and the first mounting portion 25*a* of the first horizontal rail member 21*a* can be received into the second slot 42 of the first mounting block 31. In this way the first support rack 21 can be fully locked, clamped or otherwise retained at the selected cooking height within the cooking chamber 14.

To the extent not already described, the different features and structures of the various embodiments can be used in combination, or in substitution with each other as desired. That one feature is not illustrated in all of the embodiments is not meant to be construed that it cannot be so illustrated, but is done for brevity of description. Thus, the various features of the different embodiments can be mixed and matched as desired to form new embodiments, whether or not the new embodiments are expressly described. All combinations or permutations of features described herein are covered by this disclosure.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A cooking appliance comprising:

a cooking chamber defined in part by an opposingly spaced first side wall and second side wall, the cooking chamber defining a vertical direction, a first horizontal direction, and a second horizontal direction, the cooking chamber defining an access opening;

a first mounting block and a second mounting block affixed to the first side wall within the cooking chamber and spaced from each other in the first horizontal direction, the first and second mounting blocks each having a respective body portion defining a respective first slot, longitudinally extending in the vertical direction to define a first length and a respective second slot longitudinally extending in the first horizontal direction to define a second length; and a first support rack coupleable to the first and second mounting blocks, the first support rack including a first horizontal rail member longitudinally extending in the first horizontal direction from a first end to an opposing second end, a first vertical rail member coupled to the first horizontal rail member at the first end longitudinally extending in the vertical direction, and a second vertical rail member coupled to the first horizontal rail member at the second end, longitudinally extending in the vertical direction.

2. The cooking appliance of claim 1, wherein the first horizontal rail member is disposed in the respective second slots of the first and second mounting blocks, the first vertical rail member is disposed in the first slot of the first mounting block, and the second vertical rail member is disposed in the first slot of the second mounting block.

3. The cooking appliance of claim 2, wherein the first vertical rail member is coupled via a snap-fit engagement to the first mounting block, and the second vertical rail member is coupled via a snap-fit engagement to the second mounting block.

4. The cooking appliance of claim 2, wherein the body portion of the first mounting block defining the respective first slot prevents a movement of the first vertical rail member in the first horizontal direction.

5. The cooking appliance of claim 2, wherein the body portion of the second mounting block defining the respective first slot prevents a movement of the second vertical rail member in the first horizontal direction.

6. The cooking appliance of claim 2, wherein the body portion of the first mounting block defining the respective second slot prevents a movement of the first horizontal rail member in the vertical direction.

7. The cooking appliance of claim 2, wherein the body portion of the second mounting block defining the respective second slot prevents a movement of the first horizontal rail member in the vertical direction.

8. The cooking appliance of claim 2, wherein the respective first slot and second slot of the first and second mounting blocks are straight along first and second lengths, respectively.

9. The cooking appliance of claim 8, wherein the first vertical rail member and the second vertical rail member received in the respective first slot of the first and second mounting blocks are straight.

10. The cooking appliance of claim 2, wherein the first horizontal rail member includes a first mounting portion longitudinally extending in the second horizontal direction at the first end and a second mounting portion extending in the second horizontal direction at the second end.

11. The cooking appliance of claim 10, wherein the first mounting portion is disposed in the second slot of the first mounting block, and the second mounting portion is disposed in the second slot of the second mounting block.

12. The cooking appliance of claim 10, wherein the first mounting portion and the second mounting portion received in the respective second slots of the first and second mounting blocks are substantially straight along their respective length.

13. The cooking appliance of claim 1, wherein the respective body portion of the first and second mounting blocks define a respective first aperture therethrough, and wherein the first and second mounting blocks are coupled to the first side wall via a respective fastener disposed in the respective first aperture.

14. The cooking appliance of claim 1, wherein the respective body portion of the first and second mounting blocks define a respective protrusion therefrom, and wherein the first side wall defines a set of third apertures therethrough, wherein the respective protrusion is disposed in a corresponding third aperture.

15. The cooking appliance of claim 1, further comprising a third mounting block and a fourth mounting block affixed to the second side wall within the cooking chamber and spaced from each other in the first horizontal direction, the third and fourth mounting blocks each having a respective body portion defining a respective first slot, longitudinally extending in the vertical direction, and a respective second slot longitudinally extending in the first horizontal direction; and a second support rack coupleable to the third and fourth mounting blocks, the second support rack including a second horizontal rail member longitudinally extending in the first horizontal direction from a first end to an opposing second end, a third vertical rail member coupled to the second horizontal rail member at the first end, longitudinally extending in the vertical direction, a fourth vertical rail member coupled to the second horizontal rail member at the second end, longitudinally extending in the vertical direction.

16. The cooking appliance of claim 15, further comprising a shelf extending between the first support rack and second support rack, the shelf supported by the first and second horizontal rail members.

17. The cooking appliance of claim 15, wherein the second horizontal rail member is disposed in the respective second slot of the third and fourth mounting blocks, the third vertical rail member is disposed in the first slot of the third mounting block, and the fourth vertical rail member is disposed in the first slot of the fourth mounting block.

18. The cooking appliance of claim 17, wherein the third vertical rail member is coupled via a snap-fit engagement to the third mounting block, and the fourth vertical rail member is coupled via a snap-fit engagement to the fourth mounting block.

19. The cooking appliance of claim 17, wherein the body portion of the third mounting block defining the respective first slot prevents a movement of the third vertical rail member in the first horizontal direction, and the body portion of the fourth mounting block defining the respective first slot prevents a movement of the fourth vertical rail member in the first horizontal direction.

20. The cooking appliance of claim 17, wherein the body portion of the third mounting block defining the respective second slot prevents a movement of the second horizontal rail member in the vertical direction, and wherein the body portion of the fourth mounting block defining the respective second slot further prevents a movement of the second horizontal rail member in the vertical direction.

* * * * *